US011609021B2

(12) United States Patent
Hong et al.

(10) Patent No.: US 11,609,021 B2
(45) Date of Patent: Mar. 21, 2023

(54) AIR CONDITIONER INDOOR UNIT, AIR CONDITIONER CONTROL METHOD, AIR CONDITIONER AND STORAGE MEDIUM

(71) Applicants: GD MIDEA HEATING & VENTILATING EQUIPMENT CO., LTD., Foshan (CN); MIDEA GROUP CO., LTD., Foshan (CN)

(72) Inventors: Zhirong Hong, Foshan (CN); Bingshan Jiang, Foshan (CN); Zongmin Yue, Foshan (CN)

( * ) Notice: Subject to any disclaimer, the term of this patent is extended or adjusted under 35 U.S.C. 154(b) by 360 days.

(21) Appl. No.: 16/626,339

(22) PCT Filed: Jun. 6, 2018

(86) PCT No.: PCT/CN2018/090098

§ 371 (c)(1),
(2) Date: Dec. 24, 2019

(87) PCT Pub. No.: WO2019/062195

PCT Pub. Date: Apr. 4, 2019

(65) Prior Publication Data

US 2020/0158371 A1 May 21, 2020

(30) Foreign Application Priority Data

Sep. 27, 2017 (CN) ..... 201721256516.8
Nov. 3, 2017 (CN) ..... 201711077309.0

(51) Int. Cl.
*F24F 11/873* (2018.01)
*F24F 11/63* (2018.01)
(Continued)

(52) U.S. Cl.
CPC ..... *F24F 11/873* (2018.01); *F24F 11/63* (2018.01); *F24F 11/88* (2018.01); *F24F 11/89* (2018.01);
(Continued)

(58) Field of Classification Search
CPC ..... F24F 11/873; F24F 11/63; F24F 11/88; F24F 11/89; F24F 13/0209;
(Continued)

(56) References Cited

U.S. PATENT DOCUMENTS 4,866,944 A * 9/1989 Yamazaki ..... F25B 13/00 62/228.3
4,941,325 A * 7/1990 Nuding ..... F25B 49/02 62/181
(Continued)

FOREIGN PATENT DOCUMENTS

CN 2467961 Y * 12/2001
CN 2537915 Y 2/2003
(Continued)

OTHER PUBLICATIONS

International Search Report dated Jul. 25, 2018 in the corresponding International Application No. PCT/CN2018/090098.
(Continued)

*Primary Examiner* — Marc E Norman
*Assistant Examiner* — Matthew John Moscola
(74) *Attorney, Agent, or Firm* — Kilpatrick Townsend & Stockton, LLP

(57) ABSTRACT

An air conditioner indoor unit, comprising a casing, and a fan casing, an electric heating assembly and a heat exchanger assembly which are disposed in the casing. The fan casing has a return air inlet and an air outlet, the electric heating assembly and the heat exchanger assembly are both disposed at the air outlet of the fan casing, and the electric heating assembly is located between the fan casing and the heat exchanger assembly. Further disclosed are an air conditioner control method, an air conditioner, and a storage medium. Since the electric heating assembly is disposed at the air outlet of the fan casing and between the fan casing and the heat exchanger assembly, the fan casing and the heat exchanger assembly can isolate a fire source that may be generated by the electric heating assembly when the electric heating assembly has a blow or other accident.

10 Claims, 10 Drawing Sheets

(51) Int. Cl.

| | |
|---|---|
| ***F24F 11/88*** | (2018.01) |
| ***F24F 11/89*** | (2018.01) |
| ***F24F 13/02*** | (2006.01) |
| ***F24F 13/20*** | (2006.01) |
| ***F24F 11/46*** | (2018.01) |
| ***F24F 11/52*** | (2018.01) |
| ***F24F 13/30*** | (2006.01) |
| *F24F 110/10* | (2018.01) |
| *F24F 140/20* | (2018.01) |

(52) U.S. Cl.
CPC ..... *F24F 13/0209* (2013.01); *F24F 13/0254* (2013.01); *F24F 13/20* (2013.01); *F24F 13/30* (2013.01); *F24F 11/46* (2018.01); *F24F 11/52* (2018.01); *F24F 2013/205* (2013.01); *F24F 2110/10* (2018.01); *F24F 2140/20* (2018.01)

(58) Field of Classification Search
CPC ..... F24F 13/0254; F24F 13/20; F24F 13/30; F24F 11/46; F24F 11/52; F24F 2013/205; F24F 2110/10; F24F 2140/20; F24F 13/222; F24F 13/22; F24F 2013/227
See application file for complete search history.

(56) References Cited

U.S. PATENT DOCUMENTS

| | | | | |
|---|---|---|---|---|
| 7,404,297 | B2 * | 7/2008 | Chen | F24F 8/192 62/264 |
| 2009/0056929 | A1 * | 3/2009 | Mulder | F24D 19/1096 700/275 |
| 2020/0018507 | A1 * | 1/2020 | Hirose | F24F 11/79 |

FOREIGN PATENT DOCUMENTS

| | | | | | |
|---|---|---|---|---|---|
| CN | 202392990 | U | | 8/2012 | |
| CN | 202613595 | U | | 12/2012 | |
| CN | 203501326 | U | | 3/2014 | |
| CN | 105157168 | A | | 12/2015 | |
| CN | 106871355 | A | | 6/2017 | |
| CN | 107339744 | A | * | 11/2017 | F24F 1/0007 |
| CN | 207262689 | U | | 4/2018 | |
| CN | 107990409 | A | | 5/2018 | |
| EP | 1132192 | A3 | | 1/2004 | |
| JP | 2001208382 | A | | 8/2001 | |
| KR | 100260036 | B1 | * | 8/1998 | F24F 3/14 |
| KR | 2004069711 | A | * | 8/2004 | F24F 11/63 |
| WO | WO-2013129527 | A1 | * | 9/2013 | F24F 1/0007 |

OTHER PUBLICATIONS

The first Office Action dated Apr. 18, 2019 in the corresponding CN application No. 201711077309.0.
The second Office Action dated Oct. 14, 2019 in the corresponding CN application No. 201711077309.0.

* cited by examiner

AIR CONDITIONER INDOOR UNIT, AIR CONDITIONER CONTROL METHOD, AIR CONDITIONER AND STORAGE MEDIUM

CROSS-REFERENCES TO RELATED APPLICATIONS

The present disclosure is a national phase application of International Application No. PCT/CN2018/090098, filed on Jun. 6, 2018, which claims the priority of Chinese Application No. 201721256516.8, filed in the Chinese Patent Office on Sep. 27, 2017, and the priority of Chinese Application No. 201711077309.0, filed in the Chinese Patent Office on Nov. 3, 2017, the entireties of which are herein incorporated by reference.

FIELD

The present disclosure relates to the technical field of air conditioner, in particular, to an air conditioner indoor unit, a method for controlling air conditioner, an air conditioner and a storage medium.

BACKGROUND

With the popularity of air conditioners in the home, the functions of air conditioners are also increasing. In order to solve the problem related to heating in a low temperature environment, the existing air conditioner generally has a heating function, or performs heating by setting an electric heating wire, or performs heating by setting a heat pump system; in a heat pump air conditioner, an electric heating wire is also provided for auxiliary heating.

Nowadays, the thin air duct air conditioner indoor unit usually arranges the auxiliary electric heating wire at the air outlet of the indoor unit, wherein since the electric heating wire is a potential fire source and usually the thermal insulation cotton and other materials on the air outlet pipe are used for thermal insulation, there will be security risks if the installation and protection is improper.

In addition, the water collecting tray of the air conditioner indoor unit is located at the bottom of the air conditioner, and the left and right sides of the air conditioner have a drain interface. In actual installation, it is generally fixed to the ceiling through the anti-detachment hook of a top panel of the air conditioner by using bolts. The water collecting tray of the air conditioner indoor unit is fixedly connected to the top panel. Since the top panel is horizontally arranged and the water collecting tray of the air conditioner indoor unit is also horizontally arranged after the top panel of the air conditioner is installed on the ceiling, the water collecting tray does not have a slope for drainage, causing water to be accumulated on one side and not to be discharged.

SUMMARY

The main purpose of the present disclosure is to provide an air conditioner indoor unit, a method for controlling air conditioner, an air conditioner and a storage medium, which aim at solving the problem of safety hazard caused by arranging the electric heating assembly at the air outlet of the air conditioner indoor unit in the existing air conditioner indoor unit.

Embodiments of the present disclosure provides an air conditioner indoor unit including a casing and a fan casing, an electric heating assembly and a heat exchanger assembly which are disposed in the casing, wherein the fan casing has an air returning outlet and an air outlet, both the electric heating assembly and the heat exchanger assembly are disposed at the air outlet of the fan casing, and the electric heating assembly is located between the fan casing and the heat exchanger assembly.

In one embodiment, the electric heating assembly comprises an electric heating wire and a mounting plate for fixing the electric heating wire, the mounting plate is detachably mounted at the casing, and the mounting plate is located at the air returning outlet.

In one embodiment, the indoor unit further includes an electric control box, wherein the electric control box is detachably mounted at the casing and located at the air returning outlet, and the electric heating assembly is mounted at the electric control box and electrically connected to a circuit board in the electric control box.

The air conditioner indoor unit further includes a water collecting tray assembly, wherein the water collecting tray assembly comprises a water collecting tray, a sheet metal member and a fixing component for fixedly connecting the water collecting tray with the sheet metal member, wherein the water collecting tray is provided with a drainage hole for draining at each of two opposite sides, the water collecting tray is provided with a fixing hole at either side where the drainage hole is provided, wherein the fixing holes at respective sides are in a same height, the sheet metal member is provided with mounting slots at positions corresponding to the respective fixing holes, wherein the mounting slots at respective sides are in different heights, and the fixing holes and the mounting slots in different heights at the sheet metal member are fixed through the fixing components, respectively.

Further, the sheet metal member is provided with a plurality of the mounting slots at either side, and the mounting slot is a screw hole; the plurality of the screw holes at each side of the sheet metal member are arranged at a vertical interval; and the fixing holes and the screw holes in different heights at the sheet metal member are fixed through the fixing components, respectively.

In one embodiment, a space between adjacent two screw holes in a vertical direction is between 2 cm and 3 cm.

In one embodiment, the sheet metal member is provided with one mounting slot at either side, the mounting slot is a waist groove, an extending direction of the waist groove is consistent with a vertical direction, and the fixing holes and the waist grooves are fixed through by the fixing components, respectively, at different heights for respective waist grooves.

In one embodiment, the waist groove has a length in the vertical direction of between 2 cm and 3 cm.

In one embodiment, the fixing component is a bolt.

In one embodiment, the water collecting tray is further provided with a drainage tube connected to the drainage hole and configured to guide drainage.

In one embodiment, the water collecting tray is provided with a waterproof layer for waterproofing.

Embodiments of the present disclosure further provides a method for controlling an air conditioner, wherein an air conditioner indoor unit runs a heat pump and an electric heating assembly at the same time to perform heating, and the method for controlling air conditioner includes:

detecting a current temperature of an indoor heat exchanger in real time;

determining whether the current temperature of the indoor heat exchanger is greater than or equal to a maximum temperature allowable by the indoor heat exchanger; and stopping running the heat pump to perform heating when determining that the current temperature of the indoor heat exchanger is greater than or equal to the maximum temperature allowable by the indoor heat exchanger.

In one embodiment, the method for controlling air conditioner further includes:

continuing to run the heat pump and the electric heating assembly at the same time to perform heating when determining that the current temperature of the indoor heat exchanger is less than the maximum temperature allowable by the indoor heat exchanger.

In one embodiment, prior to detecting the current temperature of the indoor heat exchanger, the method further includes:

obtaining an indoor ambient temperature;

determining whether the indoor ambient temperature is in conformity with a heating condition for the heat pump of the air conditioner;

running the heat pump and the electric heating assembly at the same time to perform heating when the indoor ambient temperature is in conformity with the heating condition for the heat pump of the air conditioner;

running the electric heating assembly only to perform heating when determining that the indoor ambient temperature is not in conformity with the heating condition for the heat pump of the air conditioner.

In one embodiment, subsequent to continuing to run the heat pump and the electric heating assembly at the same time to perform heating, the method further includes:

detecting the current indoor ambient temperature in real time;

determining whether a difference between a target temperature and the current indoor ambient temperature is less than or equal to a preset target temperature threshold;

turning off the electric heating assembly when determining that the difference between the target temperature and the current indoor ambient temperature is less than or equal to the preset target temperature threshold;

continuing to run the heat pump and the electric heating assembly at the same time to perform heating when determining that the difference between the target temperature and the current indoor ambient temperature is greater than the preset target temperature threshold.

In one embodiment, subsequent to turning off the electric heating assembly, the method further includes:

determining whether the current indoor ambient temperature reaches the target temperature after a preset time interval; and turning off the heat pump for heating when determining that the current indoor ambient temperature reaches the target temperature.

Embodiments of the present disclosure further provides an air conditioner including a processor, a memory, a computer program stored in the memory and executable by the processor, and the air conditioner indoor unit mentioned above, wherein an electric heating assembly of the air conditioner indoor unit is electrically connected to the processor, and the computer program, when executed by the processor, causes a method for controlling an air conditioner mentioned above to be performed.

Embodiments of the present disclosure further provides a storage medium having stored therein a control program for an air conditioner indoor unit that, when executed by a processor, causes a method for controlling an air conditioner mentioned above to be performed.

For an air conditioner indoor unit, a method for controlling air conditioner, an air conditioner and a storage medium provided by the embodiment of the present disclosure, the electric heating assembly is disposed at the air outlet of the fan casing, and located between the fan casing and the heat exchanger, so that when the electric heating assembly is fused to break down, the fan casing and the heat exchanger assembly can isolate the fire source that may be generated by the electric heating assembly, thereby avoiding the problem of safety hazards caused by improper installation and protection of electric heating assembly.

Figure 1:
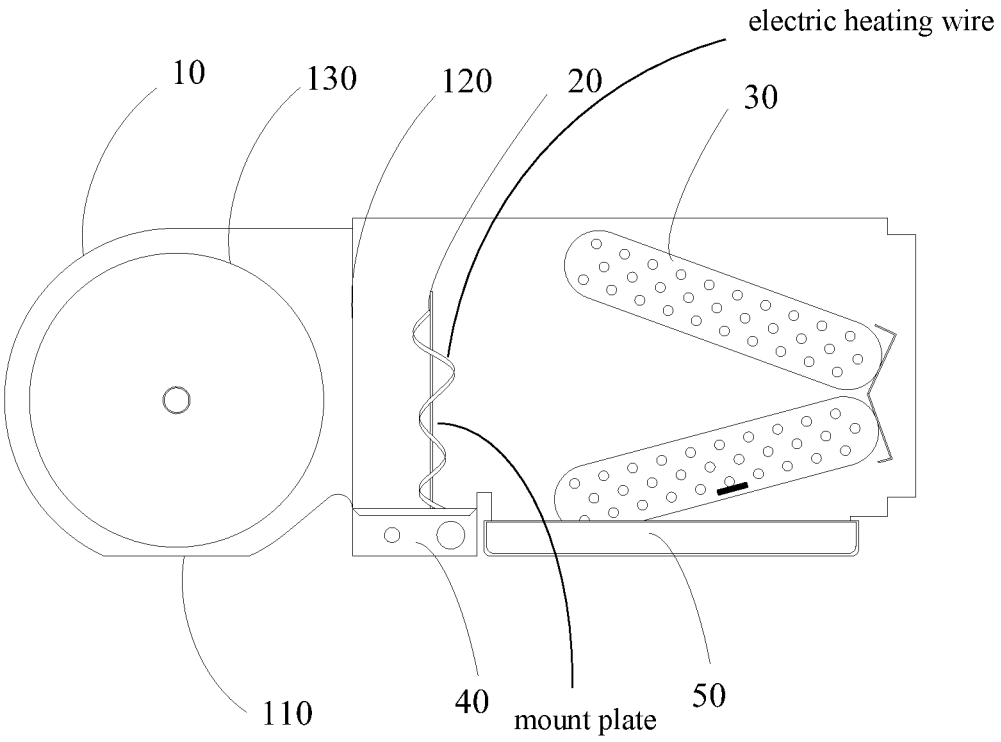
FIG. 1 is a structure diagram of an air conditioner indoor unit in the embodiment of the present disclosure.

DESCRIPTION OF THE REFERENCE NUMERALS fan casing 10, air returning outlet 110, air outlet 120, fan 130, electric heating assembly 20, heat exchanger assembly 30, electric control box 40, water collecting tray 50, drainage hole 510, fixing hole 520, drainage tube 530, metal sheet member 60, mounting slot 610, screw hole 610*a*, waist groove 610*b*, fixing component 70;

processor 1001, communication bus 1002, user interface 1003, network interface 1004, memory 1005.

DETAILED DESCRIPTION OF THE DISCLOSURE

Embodiments of the present disclosure will described in the following with reference to the accompanying drawings.

It should be noted that all directional indications (such as up, down, left, right, front, back, . . . ) in the embodiments of the present disclosure are only used to explain the relative positional relationship, motion situation and the like between components in a posture (as shown in the drawings), if the specific posture changes, the directional indication shall also change accordingly.

In addition, the descriptions of "first", "second" and the like in the present application are used for the purpose of description only, and are not to be construed as indicating or implying their relative importance or implicitly indicating the number of technical features indicated. Therefore, the characteristics indicated by the "first", the "second" can express or impliedly include at least one of the characteristics. In addition, technical schemes of different embodiments can be combined with each other.

With reference to FIG. 1, FIG. 1 is a structure diagram of an air conditioner indoor unit provided by the present disclosure, and the air conditioner indoor unit includes a casing (not shown) and a fan casing 10, an electric heating assembly 20 and a heat exchanger assembly 30 which are disposed in the casing, and the fan casing 10 has an air returning outlet 110 and an air outlet 120, both the electric heating assembly 20 and the heat exchanger assembly 30 are disposed at the air outlet 120 of the fan casing 10, and the electric heating assembly 20 is located between the fan casing 10 and the heat exchanger assembly 30.

A fan 130 is disposed in the fan casing 10, the fan 130 forms an air duct with the fan casing 10, and the air returning outlet 110 and the air outlet 120 are located at both ends of the air duct respectively; when the fan 130 rotates, an air moves from the air returning outlet 110 toward the air outlet 120 of the casing, and the electric heating assembly 20 is disposed between the fan casing 10 and the heat exchanger assembly 30, so that after the air is blown out from the air outlet 120, it is first passed through the electric heating assembly 20, then is subjected to heat exchange through the heat exchanger assembly 30, and is finally sent to the chamber.

The electric heating assembly 20 is disposed at the air outlet 120 of the fan casing 10 and located between the fan casing 10 and the heat exchanger assembly 30. In this way, the electric heating assembly 20 is surrounded by a fan casing 10 made of a sheet metal member or the heat exchanger assembly 30, so that even if the high-temperature electric heating assembly 20 is blown under abnormal conditions, a dangerous accident such as a fire may not occur at an airport connected to the outside of the air conditioner.

In an embodiment of the present disclosure, the electric heating assembly 20 is disposed at the air outlet 120 of the fan casing 10, and located between the fan casing 10 and the heat exchanger assembly 30, so that when the electric heating assembly 20 is fused to break down, the fan casing 10 and the heat exchanger assembly 30 may isolate the fire source that may be generated by the electric heating assembly 20, thereby avoiding the problem of safety hazards caused by improper installation and protection of electric heating assembly 20.

There are various ways for the electric heating assembly 20 to be installed between the fan casing 10 and the heat exchanger assembly 30. In one embodiment, the electric heating assembly 20 may be directly mounted on the casing. In one embodiment, the electric heating assembly 20 includes an electric heating wire (not shown) and a mounting plate (not shown) for fixing the electric heating wire, the mounting plate is detachably mounted at the casing, and the mounting plate is located at the air returning outlet 110.

In one embodiment, the air returning outlet 110 of the casing is provided with a mounting hole for mounting the mounting plate. When the electric heating assembly 20 is installed, the electric heating wire is inserted into the casing from the mounting hole, and the mounting plate is fixed to an edge of the mounting hole; similarly, when the electric heating assembly 20 is disassembled, the electric heating wire may be removed by removing the mounting plate from the air returning outlet 110 of the casing to facilitate replacement of the electric heating wire. Since the air returning outlet 110 is a cleaning and disassembling port of the air conditioner indoor unit, disposing the mounting plate on the air returning outlet 110 facilitates the disassembly of the electric heating assembly 20.

Or, the electric heating assembly 20 may be integrated with internal assemblies of the air conditioner indoor unit, and installed on the casing through the internal assemblies of the air conditioner indoor unit. In one embodiment, the indoor unit further includes an electric control box 40, and the electric control box 40 is detachably mounted at the casing and located at the air returning outlet 110, and the electric heating assembly 20 is mounted at the electric control box 40 and electrically connected to a circuit board in the electric control box 40.

In one embodiment, the electric control box 40 is disposed on the air returning outlet 110 of the casing and located between the fan casing 10 and the heat exchanger assembly 30, while the water collecting tray 50 in the casing is located below the heat exchanger assembly 30 on the same side as the electric control box 40. A surface of the electric control box 40 facing the inside of the casing is provided with a mounting groove; a mounting portion of the electric heating assembly 20 is mounted in the mounting groove to form an integral structure with the electric control box 40, and the electric heating wire of the electric heating assembly 20 extends away from the electric control box 40 to the inside of the casing; the electric heating wire is located between the fan casing 10 and the heat exchanger assembly 30. The electric control box 40 is detachably connected to the fan casing, so that the electric control box 40 and the electric heating assembly 20 may be directly removed from the air returning outlet 110 of the casing, thereby greatly improving the convenience in maintenance of the electric control box 40 and the electric heating assembly 20. Further, the electric heating assembly 20 is shielded by the electric control box 40, so that the blown electric heating wire may not drop outside the air conditioner, thereby completely avoiding a fire caused by the abnormality of the electric heating assembly 20.

In an embodiment of the present disclosure, with reference to FIGS. 7 to 11 and FIGS. 12 to 17, the air conditioner indoor unit further includes a water collecting tray assembly.

The water collecting tray assembly comprises a water collecting tray 50, a sheet metal member 60 and a fixing component 300 for fixedly connecting the water collecting tray 50 with the sheet metal member 60, and the water collecting tray 50 is provided with a drainage hole 510 for draining at each of two opposite sides; the water collecting tray 50 is provided with a fixing hole 520 at either side where the drainage hole 510 is provided, and the fixing holes at respective sides are in a same height, the sheet metal member 60 is provided with mounting slots 610 at positions corresponding to the respective fixing holes 520, and the mounting slots at respective sides are in different heights; the fixing holes 520 and the mounting slots 610 in different heights at the sheet metal member 60 are fixed through the fixing components 70, respectively.

In FIG. 1, the part that is in contact with the water collecting tray 50 is the sheet metal member 60, and the sheet metal member 60 is located above the water collecting tray 50.

When a top panel of the air conditioner indoor unit is installed on the ceiling, and the sheet metal member 60 is connected to the top panel to be also fixed to the ceiling; the sheet metal member 60 is connected to the water collecting tray 50, and the condensed water on a condenser may be discharged from the drainage hole 510 of the water collecting tray 50. In the present embodiment, fixing holes 520 at the same height are disposed on opposite side positions of the water collecting tray 50 and the sheet metal member 60, and the positions of the sheet metal member 60 corresponding to the two fixing holes 520 are respectively provided with mounting slots 610 having a height difference, so that when the water collecting tray 50 is connected to the sheet metal member 60, it may be sequentially fixed to the fixing holes 520 on both sides of the water collecting tray 50 and the mounting slots 610 at different heights on the sheet metal member 60 by the fixing component 70, to make the water collecting tray 50 have a slope for drainage with respect to the sheet metal member 60, i.e., to make the water collecting tray 50 dispose downward incline with respect to the sheet metal member 60. In one embodiment, the water collecting tray 50 is disposed downward incline to the left or right with respect to the sheet metal member 60, which may be set according to actual application conditions. In the present embodiment, the mounting slot 610 of the sheet metal member 60 may be a plurality of mounting holes arranged at a vertical interval, or may be an oblong hole extending in the same direction as the vertical direction.

In the technical solution of the present disclosure, fixing holes 520 at the same height are disposed on opposite side positions of the water collecting tray 50 and the sheet metal member 60, and the positions of the sheet metal member 60 corresponding to the two fixing holes 520 are respectively provided with mounting slots 610 having a height difference, so that when the water collecting tray 50 is connected to the sheet metal member 60, the fixing component 70 is directly and sequentially fixed to the fixing holes 520 on both sides of the water collecting tray 50 and the mounting slots 610 at different heights on the sheet metal member 60, to make the water collecting tray 50 have a slope for drainage with respect to the sheet metal member 60, thereby leading the condensed water on the water collecting tray 50 to be discharged from the drainage hole 510 in an orderly manner without causing water accumulation problems.

In one embodiment, with reference to FIGS. 7 to 8 and FIGS. 12 to 17, in the first embodiment, the sheet metal member 60 is provided with a plurality of mounting slots 610 on both sides, and the mounting slot 610 is a screw hole 610*a*; the plurality of screw holes 610*a* on each side of the sheet metal member 60 are arranged at an vertical interval; the fixing holes 520 and the screw holes 610*a* of different heights on the sheet metal member 60 are fixed by the fixing component 70. In the present embodiment, disposing the plurality of screw holes 610 as the mounting slots 610 and arranging the screw holes 610*a* at an vertical interval, i.e., fixing the water collecting tray 50 to the screw holes 610*a* of different heights on opposite sides of the sheet metal member 60 by the fixing component 70, may make the water collecting tray 50 have a slope for drainage. And a detachable connection formed by screwing in the fixing holes 520 and the screw holes 610*a* directly through the fixing component 70 may on the one hand facilitate adjustment of the drainage on the left or right side of the water collecting tray 50, and may on the other hand facilitate replacement of the water collecting tray 50 of different sizes at a later stage. In actual application, the size of the slope of the water collecting tray 50 may be adjusted according to the actual situation, and the adjustment in the size of the slope is determined according to the distance between the respective screw holes 610*a* in the vertical direction, and a space may be between 2 cm and 3 cm, 2.5 cm.

Figure 12:
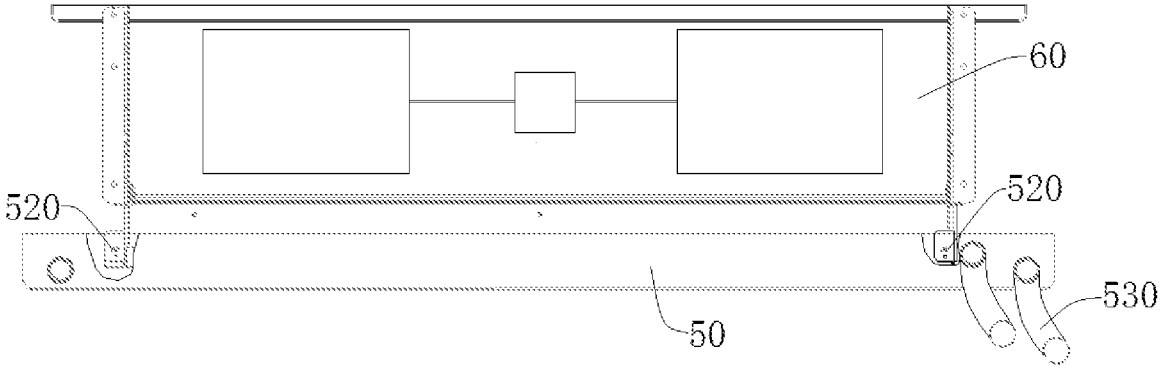
FIG. 12 is a diagram showing the overall assembly of the fixing hole and the screw hole when the water collecting tray is in a horizontal position.
Figure 13:
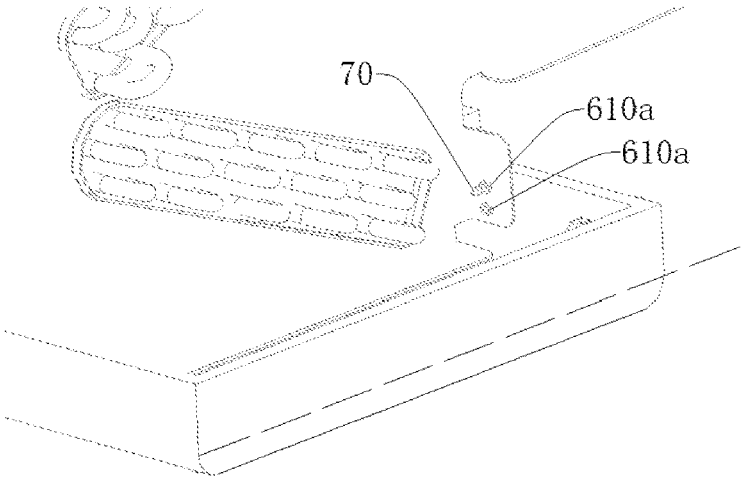
FIG. 13 is a partial diagram showing the assembly of the fixing hole and the screw hole at the right end of the water collecting tray of FIG. 12.
Figure 14:
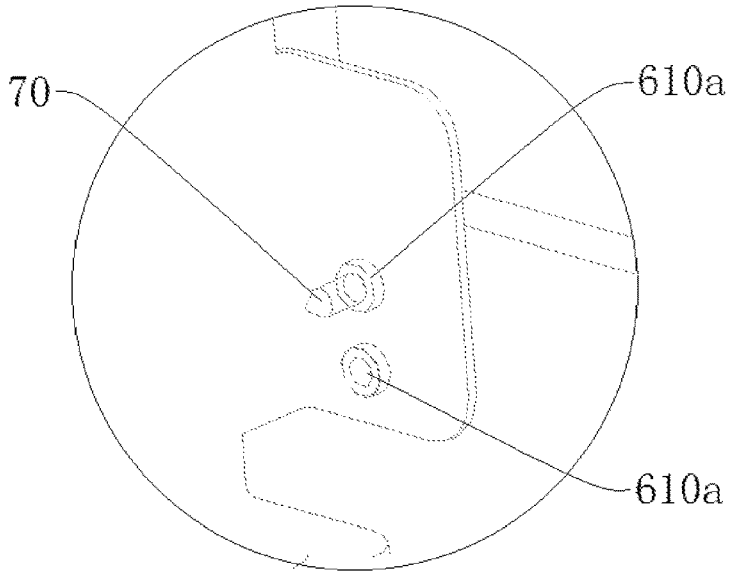
FIG. 14 is a partial diagram of FIG. 13.
Figure 15:
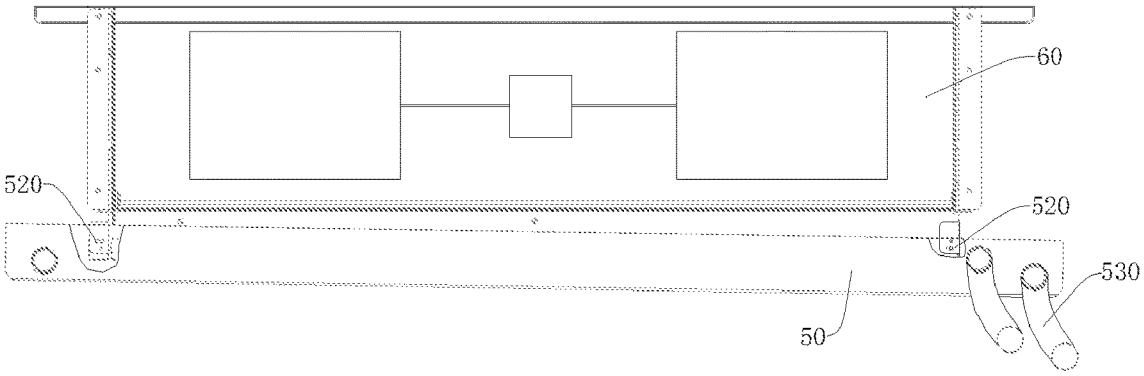
FIG. 15 is a diagram showing the overall assembly of the fixing hole and the screw hole when the water collecting tray has a slope for drainage.
Figure 16:
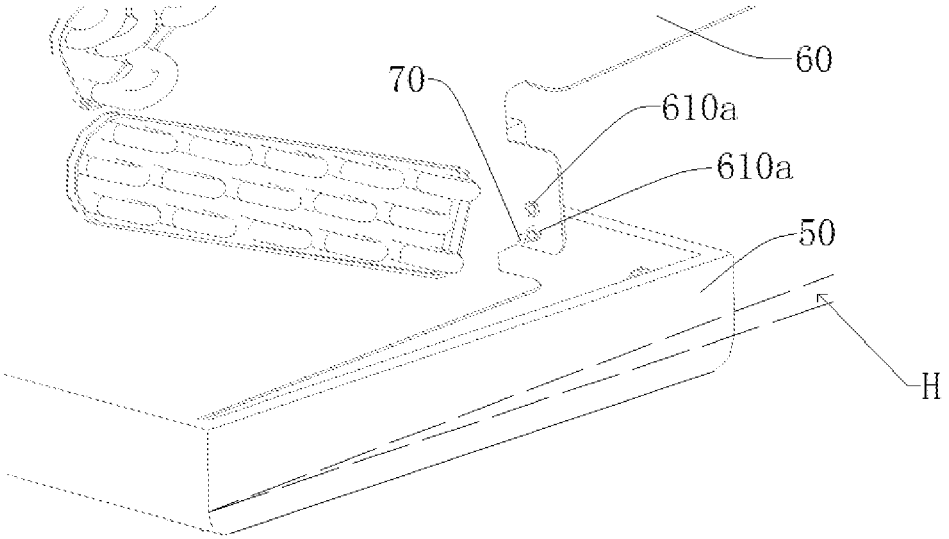
FIG. 16 is a partial diagram showing the assembly of the fixing hole and the screw hole at the right end of the water collecting tray of FIG. 15.
Figure 17:
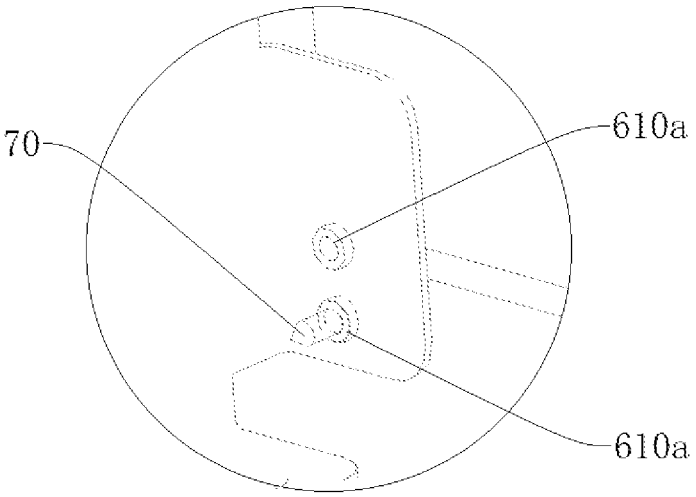
FIG. 17 is a partial diagram of FIG. 16.
Figure 18:
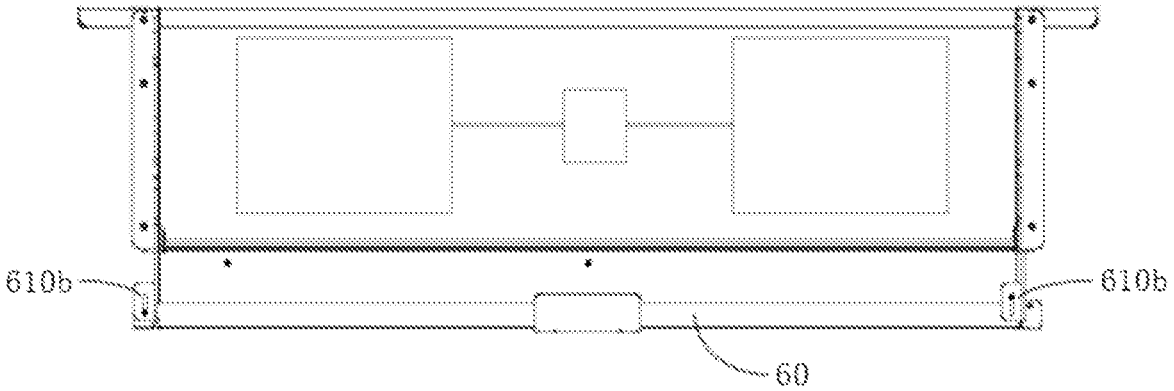
FIG. 18 is a structural diagram of a sheet metal member in a water collecting tray assembly of the present disclosure.

As shown in FIGS. 12 to 14, the fixing hole 520 and the screw hole 610*a* at a higher position on the sheet metal member 60 are fixed by the fixing component 70. In this way, the water collecting tray 50 is in a horizontal position without a slope for drainage, and at this time, the water collecting tray 50 is in a normal drainage state. In an embodiment shown in FIGS. 15 to 17, the fixing hole 520 at the left end of the water collecting tray 50 and the screw hole 610*a* at a higher position on the sheet metal member 60 are fixed by the fixing component 70, and the fixing hole 520 at the right end of the water collecting tray 50 and the screw hole 610*a* at a lower position on the sheet metal member 60 are fixed by the fixing component 70, then the right end of the water collecting tray 50 is lower than the left end, and a height difference between the two ends is H; that is to say, at this time, the water collecting tray 50 has a slope for drainage, and the water collecting tray 50 is in a state where the drainage on the right end is enhanced.

Of course, fixing the fixing hole 520 on the left end of the water collecting tray 50 and the screw hole 610*a* on a lower position on the sheet metal member 60 while fixing the fixing hole 520 on the right end of the water collecting tray 50 and the screw hole 610*a* on a higher position on the sheet metal member 60 may also make the water collecting tray 50 present a slope for drainage where the left is low while the right is high, to make the water collecting tray 50 be in a state where the drainage on the left end is enhanced.

Figure 9:
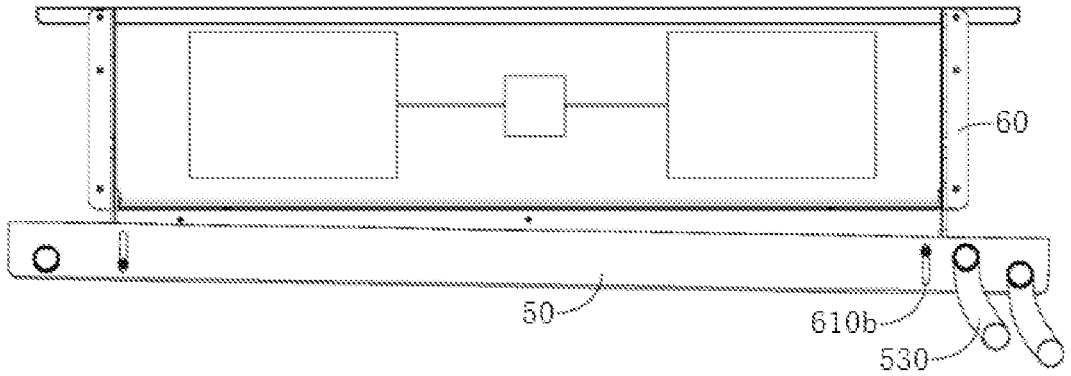
FIG. 9 is a structural diagram of a third embodiment of a water collecting tray assembly of the present disclosure.
Figure 10:
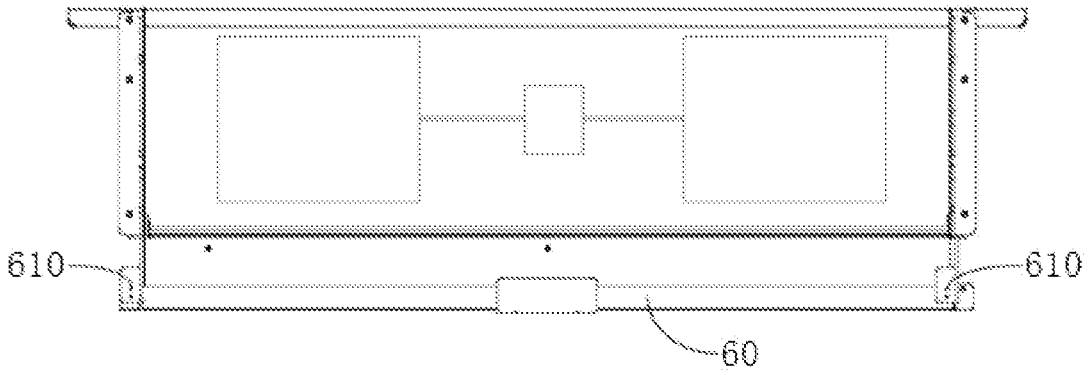
FIG. 10 is a structural diagram of a sheet metal member in a water collecting tray assembly of the present disclosure.
Figure 11:
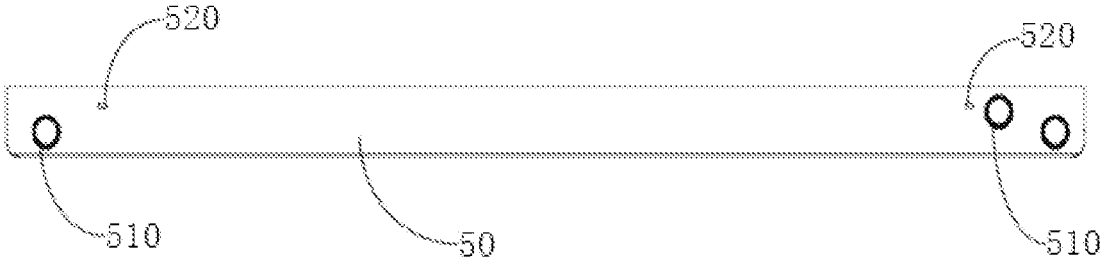
FIG. 11 is a structural diagram of a water collecting tray in a water collecting tray assembly of the present disclosure.

In one embodiment, with reference to FIG. 9, in the second embodiment, the sheet metal member 60 is provided with a mounting slot 610 on each side, and the mounting slot 610 is a waist groove 610*b*; an extending direction of the waist groove 610*b* is consistent with a vertical direction; the fixing component 70 is sequentially fixed to the fixing hole 520 and the different height positions of the waist groove 610*b* on both sides of the sheet metal member 60 to fix the water collecting tray 50 and the sheet metal member 60. In the present embodiment, the mounting slot 610 is configured as the waist groove 610*b* (i.e., oblong hole) and an extending direction of the waist groove 610*b* is consistent with a vertical direction, i.e., fixing the water collecting tray 50 to the different height positions of the waist groove 610*b* on opposite sides of the sheet metal member 60 by the fixing component 70, to make the water collecting tray 50 have a slope for drainage. And a detachable connection formed by screwing in the fixing holes 520 and the waist groove 610*b* directly through the fixing component 70 may on the one hand facilitate adjustment of the drainage on the left or right side of the water collecting tray 50, and may on the other hand facilitate replacement of the water collecting tray 50 of different sizes at a later stage. In one embodiment, the fixing component 70 is a bolt that is fitted to the screw hole 610*a* or the waist groove 610*b*. In actual application, the size of the slope of the water collecting tray 50 may be adjusted according to the actual situation, and the adjustment in the size of the slope is determined according to the adjustment distance of the fixing component 70 in the vertical direction, and, a length of the waist groove 610*b* in the vertical direction is 2 cm to 3 cm.

Further, with reference to FIG. 9, the water collecting tray 50 is further provided with a drainage tube 530 connected to the drainage hole 510 and configured to guide drainage. In the present embodiment, disposing the drainage tube 530 at the drainage hole 510 facilitates the condensed water on the water collecting tray 50 to enter a discharge channel or a recycling channel according to a drainage channel provided by the drainage tube 530, and avoids affecting normal operation caused by leakage of condensed water from the drainage hole 510 to other components of the air conditioner indoor unit.

Further, the water collecting tray 50 is provided with a waterproof layer for waterproofing. In the present embodiment, the water collecting tray 50 may be made of a metal material to enhance strength, and disposing the waterproof layer on the water collecting tray 50 may further prevent the water collecting tray 50 from being rusted by the corrosion of the condensed water. On the other hand, disposing the waterproof layer also accelerates the drainage speed of the water collecting tray 50 having a slope for drainage of condensed water.

Since the electric heating assembly is located between the fan casing and the heat exchanger assembly, when the electric heating assembly works to perform heating, the temperature of a windblown to the heat exchanger assembly is high after the air blown out in the fan casing is subjected to heat exchange by the electric heating assembly, and the heat exchange effect is poor due to influence from high temperature air when the heat pump is operated by the heat exchanger assembly for heating while the heat exchanger assembly being easily damaged when the temperature is too high. Therefore, in order to solve above problem, the present disclosure further provides a method for controlling air conditioner, to protect the heat exchanger assembly and increase the service life as well as heat transfer efficiency.

The main solution for the embodiment of a method for controlling air conditioner of the present disclosure is: detecting a current temperature of an indoor heat exchanger in real time; determining whether the current temperature of the indoor heat exchanger is greater than or equal to a maximum temperature allowable by the indoor heat exchanger; and stopping running the heat pump to perform heating when determining that the current temperature of the indoor heat exchanger is greater than or equal to the maximum temperature allowable by the indoor heat exchanger.

In some embodiments, the above maximum temperature allowable by the indoor heat exchanger is a, and a is Usually taken from 60° C. to 70° C. Of course, this value range should not be regarded as a limitation on a, and the value range of a may also be other numerical ranges not shown.

Since in the prior art the thin air duct air conditioner indoor unit usually arranges the auxiliary electric heating wire at the air outlet of the indoor unit, and since the electric heating wire is a potential fire source and usually the thermal insulation cotton and other materials on the air outlet pipe are used for thermal insulation, there will be security risks if the installation and protection is improper. Therefore, in the present disclosure, the electric heating assembly is arranged on the fan casing and the heat exchanger assembly, and then when the heat pump and the electric heating assembly are run at the same for heating in the air conditioner chamber, the electric heating assembly affects the heat exchange effect of the indoor heat exchanger, and also running the heat pump at a high temperature may easily damage the indoor heat exchanger.

The present disclosure provides a solution in which a current temperature of an indoor heat exchanger is detected in real time, and the heat pump system is stopped when determining that the current temperature of the indoor heat exchanger is greater than or equal to a preset maximum temperature allowable by the indoor heat exchanger, to reduce the temperature of the indoor heat exchanger, and ensure that the indoor heat exchanger does not continuously perform heating under the high temperature, thereby making the indoor heat exchanger not easy to be damaged and prolonging the service life.

Figure 2:
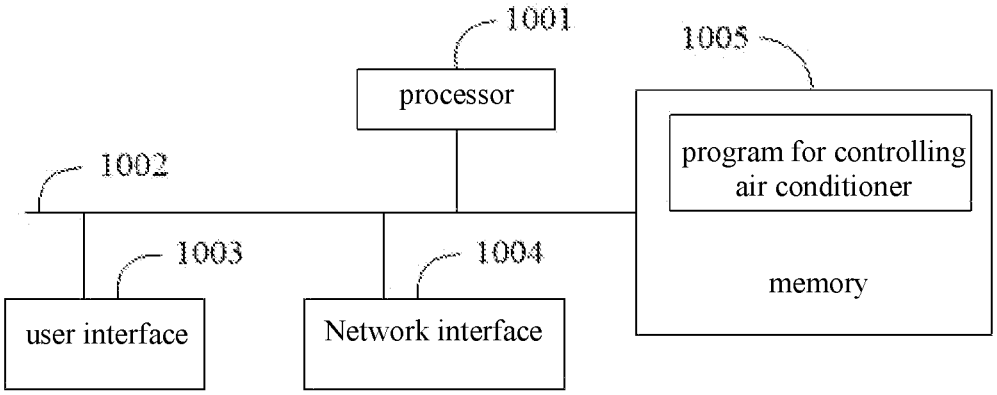
FIG. 2 is a structural schematic view of a terminal/device in a hardware running environment according to a solution in an embodiment of the present application.

As shown in FIG. 2, FIG. 2 is a structural schematic view of a terminal in a hardware running environment according to a solution in an embodiment of the present application.

The terminal in the embodiment of the present disclosure may be an air conditioner, or a control device, or electronic devices such as smart terminals and intelligent controllers, e.g., electronic devices such as mobile phones and smart home controllers.

As shown in FIG. 2, the terminal may include a processor 1001 such as a central processing unit (CPU), a network interface 1004, a user interface 1003, a memory 1005 and a communication bus 1002, and the communication bus 1002 is configured to realize connection and communication between the assemblies. The user interface 1003 may include a display, and an input unit such as a keyboard. In one embodiment, the user interface 1003 may further include a standard wired interface and a standard wireless interface. The network interface 1004, may include a standard wired interface and a standard wireless interface (such as a WiFi interface). The memory 1005 can be a high-speed RAM memory, and can also be a non-volatile memory, such as a magnetic disk memory. The memory 1005, can also be a storage device independent from the aforementioned processor 1001.

In one embodiment, the air conditioner terminal shown in FIG. 2 does not limit the structure of air conditioner terminal, and the terminal may include more or less components as shown in the figure, or have combinations of components or different arrangement of components. In one embodiment, the structure of air conditioner terminal may further include a sensor, a display module, an audio circuit, a WiFi module and a spare battery module, etc., and the sensor includes a temperature sensor and the like respectively distributed on an outer surface of the indoor heat exchanger and an air returning outlet of the air conditioner indoor unit for detecting the tube temperature of the indoor heat exchanger and the indoor ambient temperature, respectively, or for the temperature sensor for detecting the indoor ambient temperature may also be placed anywhere in the chamber; the temperature sensors are all electrically connected to the processor 1001, and the detected temperatures are all transmitted to the processor 1001.

As shown in FIG. 2, the memory 1005, as a storage medium, may include an operating system, a network communication module, a user interface module and a control application for home robots.

In the terminal as shown in FIG. 2, the network interface 1004 is mainly configured to connect to a background server and communicate data with the background server; the user interface 1003 is mainly configured to connect to a client terminal (user terminal) and communicate data with the client terminal; and the processor 1001 may be configured to invoke the control application for home robots stored in the memory 1005, and execute the following operations:

further, the processor 1001 may revoke the network operation control application stored in the memory 1005, and also performs the following operations:

detecting a current temperature of an indoor heat exchanger in real time;

determining whether the current temperature of the indoor heat exchanger is greater than or equal to a maximum temperature allowable by the indoor heat exchanger; and stopping running the heat pump to perform heating when determining that the current temperature of the indoor heat exchanger is greater than or equal to the maximum temperature allowable by the indoor heat exchanger.

further, the processor 1001 may revoke the network operation control application stored in the memory 1005, and also performs the following operations:

continuing to run the heat pump and the electric heating assembly at the same time to perform heating when determining that the current temperature of the indoor heat exchanger is less than the maximum temperature allowable by the indoor heat exchanger.

further, the processor 1001 may revoke the network operation control application stored in the memory 1005, and also performs the following operations:

obtaining an indoor ambient temperature;

determining whether the indoor ambient temperature is in conformity with a heating condition for the heat pump of the air conditioner;

running the heat pump and the electric heating assembly at the same time to perform heating when the indoor ambient temperature is in conformity with the heating condition for the heat pump of the air conditioner;

running the electric heating assembly only to perform heating when determining that the indoor ambient temperature is not in conformity with the heating condition for the heat pump of the air conditioner.

further, the processor 1001 may revoke the network operation control application stored in the memory 1005, and also performs the following operations:

detecting the current indoor ambient temperature in real time;

determining whether a difference between a target temperature and the current indoor ambient temperature is less than or equal to a preset target temperature threshold;

turning off the electric heating assembly when determining that the difference between the target temperature and the current indoor ambient temperature is less than or equal to the preset target temperature threshold;

continuing to run the heat pump and the electric heating assembly at the same time to perform heating when determining that the difference between the target temperature and the current indoor ambient temperature is greater than the preset target temperature threshold.

In some embodiments, the above target temperature threshold is b, and b is usually taken from 2° C. to 4° C. Similarly, this value range should not be regarded as a limitation on b, and the value range of b may also be other numerical ranges not shown.

Further, the processor 1001 may revoke the network operation control application stored in the memory 1005, and also performs the following operations:

determining whether the current indoor ambient temperature reaches the target temperature after a preset time interval; and turning off the heat pump for heating when determining that the current indoor ambient temperature reaches the target temperature.

Figure 3:
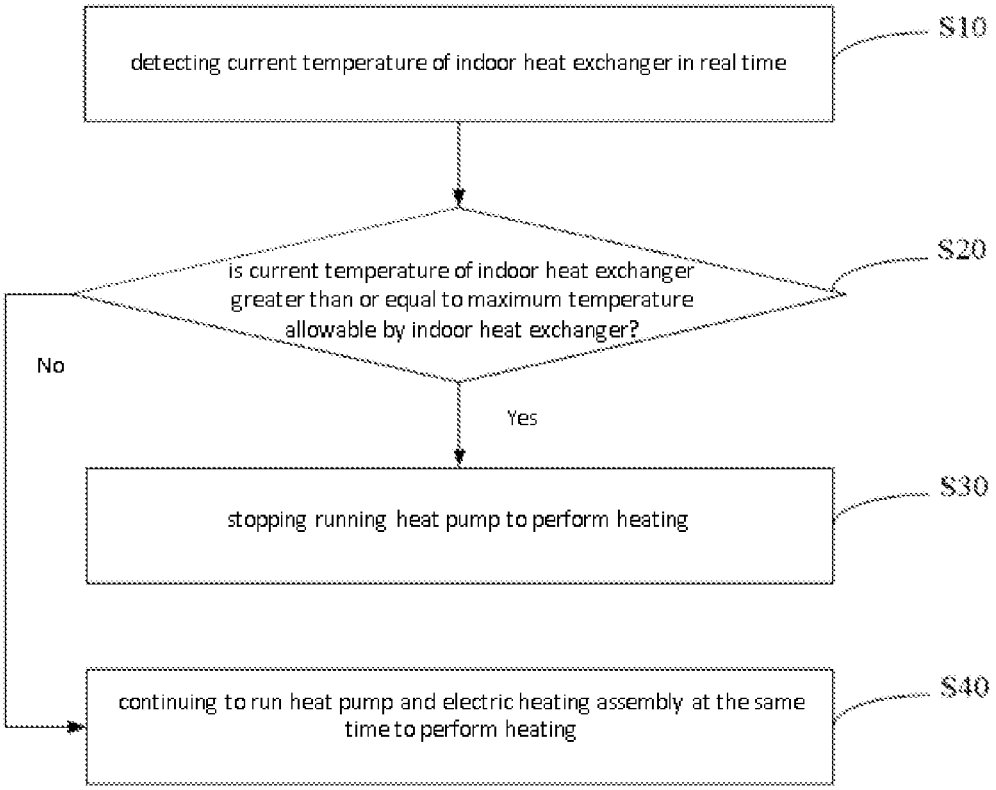
FIG. 3 is a flow chart of a first embodiment of a method for controlling air conditioner in the embodiment of the present disclosure.

With reference to FIG. 3, FIG. 3 is a first embodiment of a method for controlling air conditioner provided by the present disclosure, the method including:

step S10, detecting a current temperature of an indoor heat exchanger in real time;

the current temperature of the indoor heat exchanger is the current tube temperature of the indoor heat exchanger, In one embodiment a current temperature of an outer surface of a heat exchange tube of the indoor heat exchanger, and a temperature sensor is disposed on the outer surface of the indoor heat exchanger to detect the temperature of the indoor heat exchanger in real time.

Step S20, determining whether the current temperature of the indoor heat exchanger is greater than or equal to a maximum temperature allowable by the indoor heat exchanger;

the maximum temperature allowable by the indoor heat exchanger is a critical temperature value where the indoor heat exchanger is easily damaged, or the maximum temperature allowable by the indoor heat exchanger is a safe operating temperature when the indoor heat exchanger performs heating. When the temperature of the indoor heat exchanger is higher than the maximum temperature, the indoor heat exchanger is easily damaged if it continues to perform heating at this temperature. Due to the influence of heating performed by the electric heating assembly on the indoor heat exchanger, in order to ensure that the indoor heat exchanger is always in a safe state during the heating process, the maximum temperature allowable by the indoor heat exchanger is preset, and whether the current temperature of the indoor heat exchanger is greater than or equal to the maximum temperature allowable by the indoor heat exchanger is monitored in real time.

Step S30, stopping running the heat pump to perform heating when determining that the current temperature of the indoor heat exchanger is greater than or equal to the maximum temperature allowable by the indoor heat exchanger.

When the current temperature of the indoor heat exchanger is greater than or equal to the maximum temperature allowable by the indoor heat exchanger, the indoor heat exchanger has reached a highest temperature value that may be withstood, then the indoor heat exchanger is easily damaged and the heat exchange efficiency is extremely low if the heat pump is continuously allowed to perform heating. Therefore, in order to protect the indoor heat exchanger and avoid waste of resources, the system is controlled to stop running the heat pump performing heating, and only the electric heating assembly is run to perform heating, to meet the requirements for indoor ambient temperature.

Step S40, continuing to run the heat pump and the electric heating assembly at the same time to perform heating when determining that the current temperature of the indoor heat exchanger is less than the maximum temperature allowable by the indoor heat exchanger.

When the current temperature of the indoor heat exchanger is less than the maximum temperature allowable by the indoor heat exchanger, the current tube temperature of the indoor heat exchanger does not affect the service life of the indoor heat exchanger and the influence on heat exchange efficiency is small, so the heat pump and the electric heating assembly are run at the same time to perform heating in order to quickly meet the requirements for heating indoors.

In the embodiment of the present disclosure, a current temperature of an indoor heat exchanger is detected in real time, and the heat pump system is stopped when determining that the current temperature of the indoor heat exchanger is greater than or equal to a preset maximum temperature allowable by the indoor heat exchanger, to reduce the temperature of the indoor heat exchanger, and ensure that the indoor heat exchanger does not continuously perform heating under the high temperature, thereby making the indoor heat exchanger not easy to be damaged and prolonging the service life.

It is to be understood that in the embodiment of the present disclosure, the temperature at an inlet end and the temperature at an outlet end of the indoor heat exchanger may also be detected in real time and a heat exchange efficiency of the indoor heat exchanger may be determined by the temperature at the inlet end and the temperature at the outlet end of the indoor heat exchanger, to determine whether the heat exchange efficiency is lower than a preset minimum heat exchange efficiency, so that when the heat exchange efficiency is lower than the minimum heat exchange efficiency, the heat pump is stopped in performing heating.

Since the heat exchange efficiency of the indoor heat exchanger is affected during the heating process of the electric heating assembly, by monitoring the heat exchange efficiency of the indoor heat exchanger in real time, the heat pump is stopped in performing heating in time, and only the electric heating assembly is operated to performing heating when the heat exchange efficiency of the indoor heat exchanger is poor, to reduce resource waste.

Figure 4:
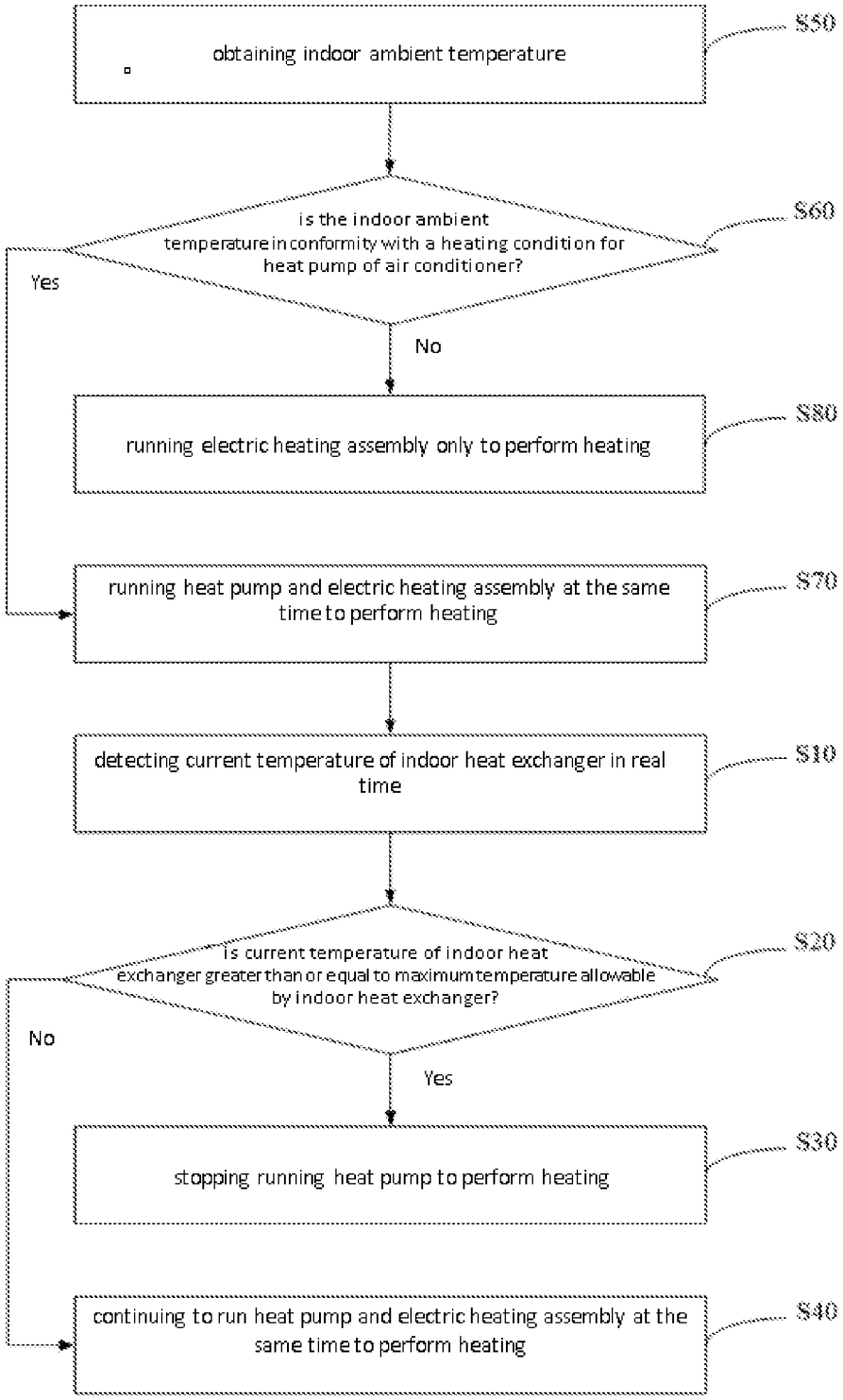
FIG. 4 is a flow chart of a second embodiment of a method for controlling air conditioner in the embodiment of the present disclosure.

With reference to FIG. 4, FIG. 4 is a second embodiment of a method for controlling air conditioner provided by the present disclosure. Based on the embodiment shown in FIG. 3, prior to the step S10 of detecting the current temperature of the indoor heat exchanger, the method further includes:

step S50, obtaining an indoor ambient temperature;

a temperature sensor is disposed at an air returning outlet of the air conditioner indoor unit or at an arbitrary position in the chamber to detect the indoor ambient temperature in real time.

Step S60, determining whether the indoor ambient temperature is in conformity with a heating condition for the heat pump of the air conditioner;

The heating condition for the heat pump is a preset condition for turning on the heat pump to perform heating in the air conditioner. When the indoor ambient temperature reaches a temperature value, whether a condition for turning on the heat pump to perform heating is satisfied is determined, or when a command for turning on the heat pump sent by the user is received, whether a condition for turning on the heat pump to perform heating is satisfied is determined. After the air conditioner is turned on, the system automatically enters performing heating by the heat pump.

Step S70, running the heat pump and the electric heating assembly at the same time to perform heating when the indoor ambient temperature is in conformity with the heating condition for the heat pump of the air conditioner;

The electric heating assembly is mainly used for auxiliary heating; in the heat pump air conditioner, the electric heating assembly may be turned on for perform heating while turning on the heat pump system, so that the indoor temperature is rapidly increased, or the electric heating unit is turned on to perform heating at the same time according to the demand of the indoor ambient temperature after the heat pump system is turned on for a period of time to speed up the indoor environment temperature and quickly achieve heating efficiency.

Step S80, running the electric heating assembly only to perform heating when determining that the indoor ambient temperature is not in conformity with the heating condition for the heat pump of the air conditioner.

The heating condition for the heat pump is a preset condition for turning on the heat pump to perform heating in the air conditioner; when the indoor ambient temperature reaches a temperature value, whether a condition for turning on the heat pump to perform heating is not satisfied by the current indoor ambient is determined, or when a command for turning on the heat pump sent by the user is not received, whether a condition for turning on the heat pump to perform heating is not satisfied is determined, so then, only the electric heating assembly is run by the air conditioner to perform heating.

In the present embodiment, determining in advance whether the indoor ambient temperature has reached the condition for turning on the heat pump to perform heating, and then turning on the heat pump to perform heating when the condition for turning on the heat pump to perform heating is reached, may prevent the heat exchange efficiency of the indoor heat exchanger from being poor when the indoor ambient temperature is not low enough, and the indoor heat exchanger from being damaged when operating at a high temperature.

Figure 5:
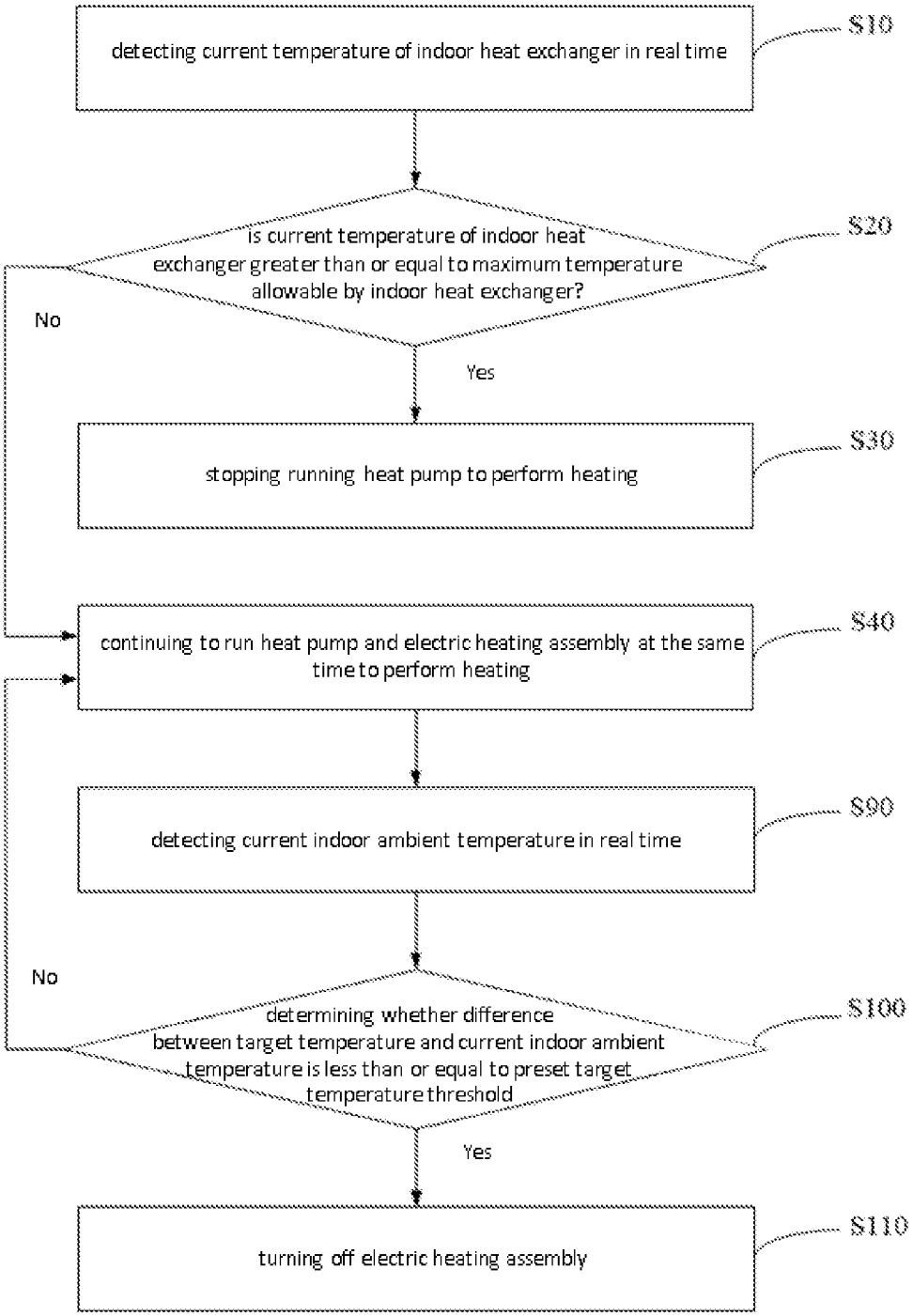
FIG. 5 is a flow chart of a third embodiment of a method for controlling air conditioner in the embodiment of the present disclosure.

With reference to FIG. 5, FIG. 5 is a third embodiment of a method for controlling air conditioner provided by the present disclosure. Based on the embodiments shown in FIGS. 3 and/or 4, subsequent to the step S40 of continuing to run the heat pump and the electric heating assembly at the same time to perform heating, the method further includes:

step S90, detecting the current indoor ambient temperature in real time;

step S100, determining whether a difference between a target temperature and the current indoor ambient temperature is less than or equal to a preset target temperature threshold;

The target temperature is a demanding temperature preset by the user, and the target temperature threshold is a preset temperature difference acceptable by the user. That is, when a difference between the target temperature and the current indoor ambient temperature is within the temperature difference range, the current indoor ambient temperature is a comfortable temperature acceptable by the user.

Step S110, turning off the electric heating assembly when determining that the difference between the target temperature and the current indoor ambient temperature is less than or equal to the preset target temperature threshold;

When the difference between the target temperature and the current indoor ambient temperature is less than or equal to the preset target temperature threshold, i.e., when the current indoor ambient temperature has reached a preset temperature range acceptable by the user, also, i.e., when the current indoor ambient temperature has reached a comfortable temperature, the electric heating assembly may be turned off to perform heating in order to save energy, and only the heat pump may be run to perform heating for bringing the indoor temperature to the target temperature preset by the user, so that the influence of the electric heating assembly is prevented against the heating performed by the indoor heat exchanger.

Further, the heat pump and the electric heating assembly are continuously run at the same time to perform heating when determining that the difference between the target temperature and the current indoor ambient temperature is greater than the preset target temperature threshold.

When the difference between the target temperature and the current indoor ambient temperature is greater than the preset target temperature threshold, i.e., when the current indoor ambient temperature differs greatly from the target temperature, the indoor ambient temperature has not reached the target temperature preset by the user, then the heat pump and the electric heating assembly are continuously run at the same time to perform heating in order to make the indoor temperature quickly reach the target temperature preset by the user.

It is to be understood that in order to make the indoor temperature quickly reach the target temperature preset by the user, the power of the electric heating assembly may also be increased or the parameters for performing heating of the air conditioner heat pump may also be adjusted, to make the indoor temperature quickly reach the target temperature preset by the user, so that the fastest speed to achieve the user's comfort may be realized.

In the present embodiment, monitoring the current indoor ambient temperature in real time, determining whether a difference between a target temperature and the current indoor ambient temperature is less than or equal to a preset target temperature threshold, and turning off the electric heating assembly when determining that the difference between the target temperature and the current indoor ambient temperature is less than or equal to the preset target temperature threshold, may save the energy.

Figure 6:
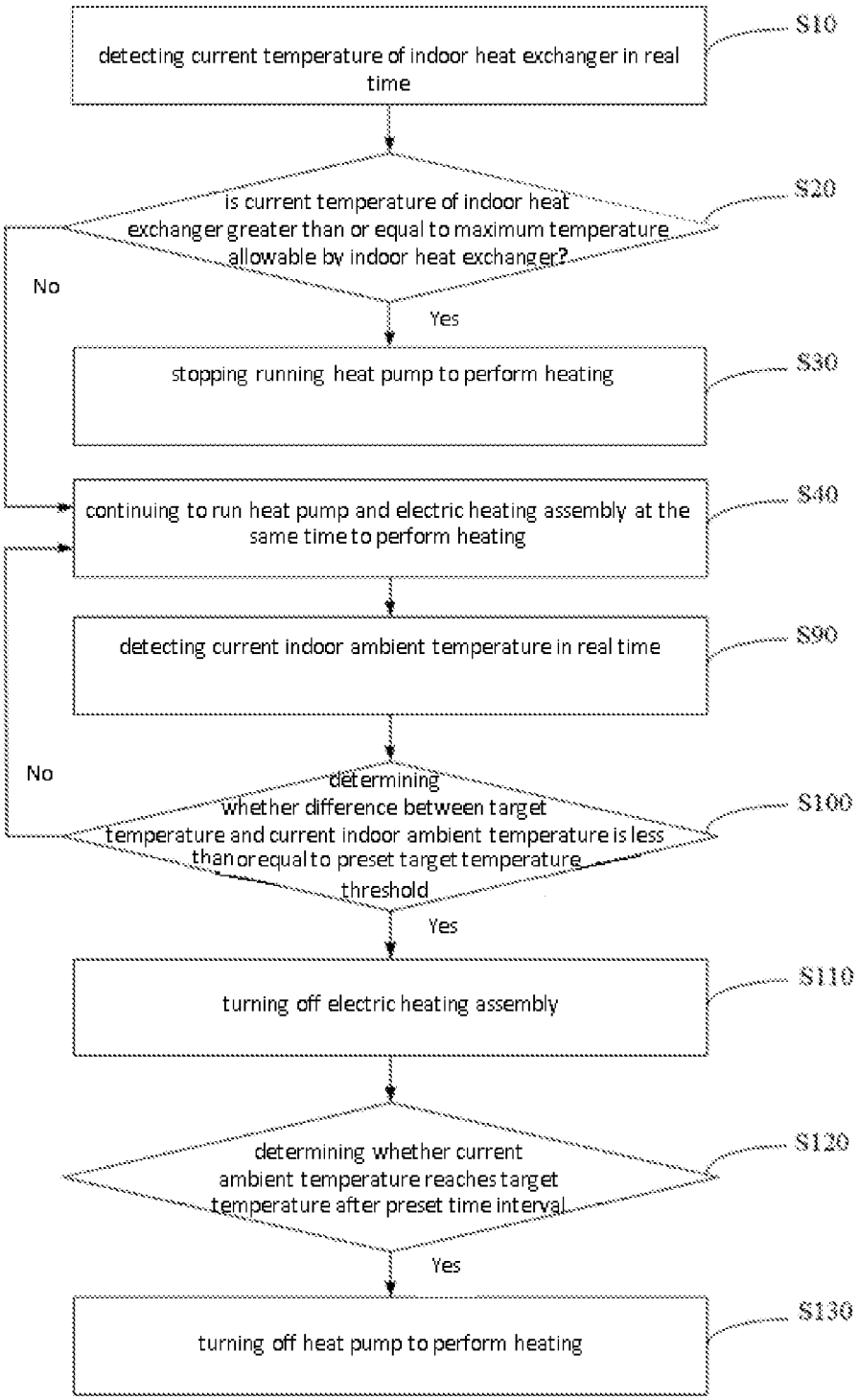
FIG. 6 is a flow chart of a fourth embodiment of a method for controlling air conditioner in the embodiment of the present disclosure.

With reference to FIG. 6, FIG. 6 is a fourth embodiment of a method for controlling air conditioner provided by the present disclosure. Based on the embodiment shown in FIG. 5, subsequent to the step S110 of turning off the electric heating assembly, the method further includes:

step S120, determining whether the current indoor ambient temperature reaches the target temperature after a preset time interval;

After the difference between the target temperature and the current indoor ambient temperature is less than or equal to the preset target temperature threshold, the current indoor ambient temperature has reached a preset temperature range acceptable by the user, so that whether the current indoor ambient temperature reaches the target temperature may be determined after a preset time interval to determine whether to continuously run the heat pump to perform heating or to stop running the heat pump in performing heating.

Step S130, turning off the heat pump for heating when determining that the current indoor ambient temperature reaches the target temperature.

When the current indoor ambient temperature reaches the target temperature, in order to prevent the heat pump from being continuously run to perform heating after the current indoor ambient temperature reaches the target temperature, and hence in order not to affect the user's experience caused by too high indoor environment temperature on the one hand and in order not to cause resources waste on the other hand, the heat pump is turned off to perform heating when the current indoor ambient temperature reaches the target temperature, and the heat pump and/or electric heating assembly is restarted to perform heating when the indoor ambient temperature is lower than the preset acceptable temperature range.

It can be understood that after the difference between the target temperature and the current indoor ambient temperature is less than or equal to the preset target temperature threshold and the electric heating assembly is turned off, the heat pump is directly turned off in performing heating after a time interval is preset. The user or the system may default that the current indoor ambient temperature at the current time has reached the target temperature preset by the user after a time interval preset after the electric heating assembly is turned off, then the heat pump is turned off to perform heating to save energy, or the system may default that the indoor ambient temperature at the current time point has reached the target temperature preset by the user after the time point is reached according to a customary time point for customarily turning of the heat pump to perform heating after the electric heating assembly is turned off, then the system automatically turn off the heat pump to perform heating.

In the present embodiment, whether the current indoor ambient temperature reaches the target temperature is determined after a preset time interval, and when the current indoor ambient temperature reaches the target temperature, the heat pump is turned off in performing heating to save energy and achieve environmental protection purposes.

The present disclosure further provides an air conditioner including a processor, a memory, a computer program stored in the memory and executable by the processor, and the air conditioner indoor unit mentioned above, and an electric heating assembly of the air conditioner indoor unit is electrically connected to the processor, and the computer program, when executed by the processor, causes a method for controlling an air conditioner mentioned above to be performed.

Furthermore, the present disclosure further provides a storage medium having stored therein a control program for an air conditioner indoor unit that, when executed by a processor, causes a method for controlling an air conditioner mentioned above to be performed.

Embodiments of the present disclosure can be implemented by means of software plus a necessary general hardware platform, and of course, can also be implemented through hardware, but in many cases, the former is better. Based on the understanding, the technical schemes of the present application in essence illustrate the part contributing to the prior art or the part of the technical schemes in the form of a software product, the computer software product is stored in a storage medium (such as ROM/RAM, disk, CD), including some instructions for making a terminal device (mobile phone, computer, server, air-conditioner, home robot or network device and the like) implement the methods in the embodiments of the present application.

The present disclosure further provides a water collecting tray assembly.

In the embodiment of the present disclosure, with reference to FIGS. 7, 8, 9, 10 and 11, the water collecting tray assembly is used for the air conditioner indoor unit.

The water collecting tray assembly comprises a water collecting tray 50, a sheet metal member 60 and a fixing component 300 for fixedly connecting the water collecting tray 50 with the sheet metal member 60, and the water collecting tray 50 is provided with a drainage hole 510 for draining at each of two opposite sides; the water collecting tray 50 is provided with a fixing hole 520 at either side where the drainage hole 510 is provided, and the fixing holes at respective sides are in a same height, the sheet metal member 60 is provided with mounting slots 610 at positions corresponding to the respective fixing holes 520, and the mounting slots at respective sides are in different heights; the fixing holes 520 and the mounting slots 610 in different heights at the sheet metal member 60 are fixed through the fixing components 70, respectively.

When a top panel of the air conditioner indoor unit is installed on the ceiling, and the sheet metal member 60 is connected to the top panel to be also fixed to the ceiling; the sheet metal member 60 is connected to the water collecting tray 50, and the condensed water on a condenser may be discharged from the drainage hole 510 of the water collecting tray 50. In the present embodiment, fixing holes 520 at the same height are disposed on opposite side positions of the water collecting tray 50 and the sheet metal member 60, and the positions of the sheet metal member 60 corresponding to the two fixing holes 520 are respectively provided with mounting slots 610 having a height difference, so that when the water collecting tray 50 is connected to the sheet metal member 60, it may be sequentially fixed to the fixing holes 520 on both sides of the water collecting tray 50 and the mounting slots 610 at different heights on the sheet metal member 60 by the fixing component 70, to make the water collecting tray 50 have a slope for drainage with respect to the sheet metal member 60, i.e., to make the water collecting tray 50 dispose downward incline with respect to the sheet metal member 60. In one embodiment, the water collecting tray 50 is disposed downward incline to the left or right with respect to the sheet metal member 60, which may be set according to actual application conditions. In the present embodiment, the mounting slot 610 of the sheet metal member 60 may be a plurality of mounting holes arranged at a vertical interval, or may be an oblong hole extending in the same direction as the vertical direction.

In the technical solution of the present disclosure, fixing holes 520 at the same height are disposed on opposite side positions of the water collecting tray 50 and the sheet metal member 60, and the positions of the sheet metal member 60 corresponding to the two fixing holes 520 are respectively provided with mounting slots 610 having a height difference, so that when the water collecting tray 50 is connected to the sheet metal member 60, the fixing component 70 is directly and sequentially fixed to the fixing holes 520 on both sides of the water collecting tray 50 and the mounting slots 610 at different heights on the sheet metal member 60, to make the water collecting tray 50 have a slope for drainage with respect to the sheet metal member 60, to lead the condensed water on the water collecting tray 50 to be discharged from the drainage hole 510 in an orderly manner without causing water accumulation problems.

Figure 7:
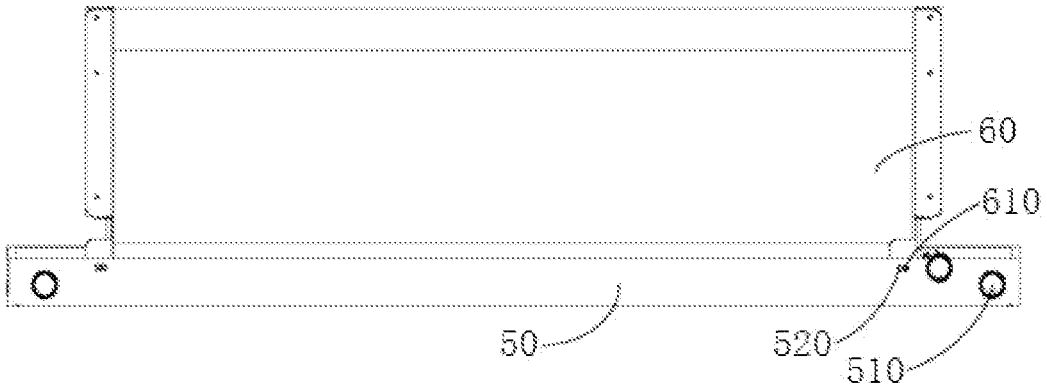
FIG. 7 is a structural diagram of a first embodiment of a water collecting tray assembly of the present disclosure.
Figure 8:
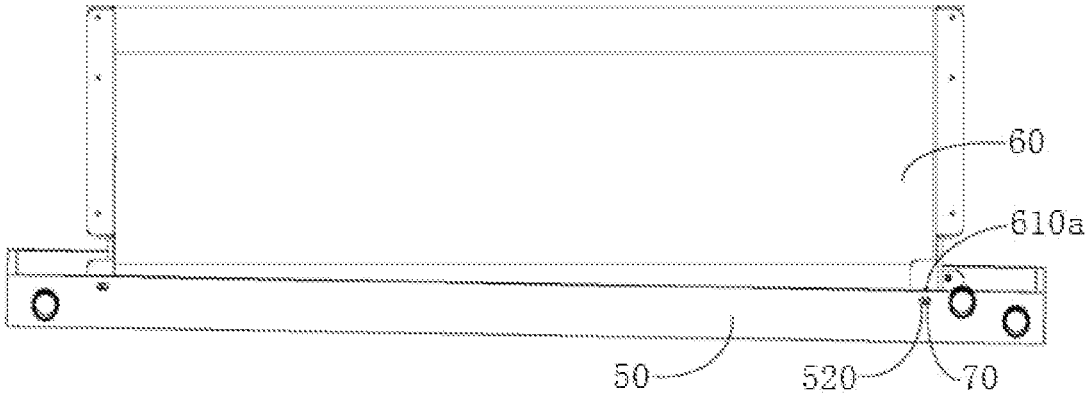
FIG. 8 is a structural diagram of a second embodiment of a water collecting tray assembly of the present disclosure.

In one embodiment, with reference to FIGS. 7 to 8, in the first embodiment, the sheet metal member 60 is provided with a plurality of mounting slots 610 on both sides, and the mounting slot 610 is a screw hole 610*a*; the plurality of screw holes 610*a* on each side of the sheet metal member 60 are arranged at an vertical interval; the fixing holes 520 and the screw holes 610*a* of different heights on the sheet metal member 60 are fixed by the fixing component 70. In the present embodiment, disposing the plurality of screw holes 610 as the mounting slots 610 and arranging the screw holes 610*a* at an vertical interval, i.e., fixing the water collecting tray 50 to the screw holes 610*a* of different heights on opposite sides of the sheet metal member 60 by the fixing component 70, may make the water collecting tray 50 have a slope for drainage. And a detachable connection formed by screwing in the fixing holes 520 and the screw holes 610*a* directly through the fixing component 70 may on the one hand facilitate adjustment of the drainage on the left or right side of the water collecting tray 50, and may on the other hand facilitate replacement of the water collecting tray 50 of different sizes at a later stage. In actual application, the size of the slope of the water collecting tray 50 may be adjusted according to the actual situation, and the adjustment in the size of the slope is determined according to the distance between the respective screw holes 610*a* in the vertical direction, and a space may be between 2 cm and 3 cm, 2.5 cm.

In one embodiment, with reference to FIG. 9, in the second embodiment, the sheet metal member 60 is provided with a mounting slot 610 on each side, and the mounting slot 610 is a waist groove 610*b*; an extending direction of the waist groove 610*b* is consistent with a vertical direction; the fixing component 70 is sequentially fixed to the fixing hole 520 and the different height positions of the waist groove 610*b* on both sides of the sheet metal member 60 to fix the water collecting tray 50 and the sheet metal member 60. In the present embodiment, the mounting slot 610 is configured as the waist groove 610*b* (i.e., oblong hole) and an extending direction of the waist groove 610*b* is consistent with a vertical direction, i.e., fixing the water collecting tray 50 to the different height positions of the waist groove 610*b* on opposite sides of the sheet metal member 60 by the fixing component 70, to make the water collecting tray 50 have a slope for drainage. And a detachable connection formed by screwing in the fixing holes 520 and the waist groove 610*b* directly through the fixing component 70 may on the one hand facilitate adjustment of the drainage on the left or right side of the water collecting tray 50, and may on the other hand facilitate replacement of the water collecting tray 50 of different sizes at a later stage. In one embodiment, the fixing component 70 is a bolt that is fitted to the screw hole 610*a* or the waist groove 610*b*. In actual application, the size of the slope of the water collecting tray 50 may be adjusted according to the actual situation, and the adjustment in the size of the slope is determined according to the adjustment distance of the fixing component 70 in the vertical direction, and, a length of the waist groove 610*b* in the vertical direction is 2 cm to 3 cm.

Further, with reference to FIG. 9, the water collecting tray 50 is further provided with a drainage tube 530 connected to the drainage hole 510 and configured to guide drainage. In the present embodiment, disposing the drainage tube 530 at the drainage hole 510 facilitates the condensed water on the water collecting tray 50 to enter a discharge channel or a recycling channel according to a drainage channel provided by the drainage tube 530, and avoids affecting normal operation caused by leakage of condensed water from the drainage hole 510 to other components of the air conditioner indoor unit.

Further, the water collecting tray 50 is provided with a waterproof layer for waterproofing. In the present embodiment, the water collecting tray 50 may be made of a metal material to enhance strength, and disposing the waterproof layer on the water collecting tray 50 may further prevent the water collecting tray 50 from being rusted by the corrosion of the condensed water. On the other hand, disposing the waterproof layer also accelerates the drainage speed of the water collecting tray 50 having a slope for drainage of condensed water.

The present disclosure further provides an air conditioner indoor unit including a water collecting tray assembly. The specific structure of the water collecting tray assembly is with reference to the above embodiments. Since the air conditioner indoor unit adopts all the technical schemes of all the above embodiments, it has at least all the beneficial effects brought about by the technical schemes of the above embodiments, and details are not described herein again.

The present disclosure further provides an air conditioning device including an air conditioner indoor unit. The specific structure of the air conditioner indoor unit is with reference to the above embodiments. Since the air conditioning device adopts all the technical schemes of all the above embodiments, it has at least all the beneficial effects brought about by the technical schemes of the above embodiments, and details are not described herein again.

It should be noted that terms "comprising", "including" or any other variants herein are intended to cover the non-exclusive including, to make that the process, method, merchandise or system comprising a series of elements comprise not only those elements but also other elements that are not listed explicitly or the inherent elements to the process, method, merchandise or system. In the case of no more limitations, the element limited by the sentence "comprising a . . . " does not exclude that there exists another same element in the process, method, merchandise or system comprising the element.

What is claimed is:

1. An air conditioner indoor unit, comprising:

a casing;

a fan casing, an electric heater and a heat exchanger assembly which are all disposed in the casing; and a water collecting tray assembly;

wherein the fan casing has an air returning vent and an air outlet, the electric heater is disposed adjacent to the air outlet and is disposed between the fan casing and the heat exchanger assembly;

wherein the water collecting tray assembly comprises a water collecting tray, a sheet metal member and a fastener for fixedly connecting the water collecting tray and the sheet metal member;

wherein the water collecting tray is provided with a drainage hole for draining at each of two opposite sides, the water collecting tray is provided with a fixing hole at either side where the drainage hole is provided, and the fixing holes at respective sides have same height;

wherein the sheet metal member is provided with mounting slots at positions corresponding to respective fixing holes, the mounting slots at respective sides have different heights, and the fixing holes and the mounting slots are fixed through the fasteners.

2. The air conditioner indoor unit according to claim 1, wherein the electric heater comprises an electric heating wire and a mounting plate for fixing the electric heating wire, and the mounting plate is detachably mounted at the casing.

3. The air conditioner indoor unit according to claim 1, further comprising an electric control box, wherein the electric control box is detachably mounted at the casing, and the electric heater is electrically connected to a circuit board in the electric control box.

4. The air conditioner indoor unit according to claim 1, wherein the sheet metal member is provided with a plurality of the mounting slots at either side, and the mounting slot is a screw hole; the plurality of the screw holes at each side of the sheet metal member are arranged at a vertical interval; and the fixing holes and the screw holes in different heights at the sheet metal member are fixed through the fasteners, respectively.

5. The air conditioner indoor unit according to claim 4, wherein a space between adjacent two screw holes in a vertical direction is between 2 cm and 3 cm.

6. The air conditioner indoor unit according to claim 1, wherein the sheet metal member is provided with one mounting slot at either side, the mounting slot is a waist groove, an extending direction of the waist groove is consistent with a vertical direction, and the fixing holes and the waist grooves are fixed through by the fasteners, respectively, at different heights for respective waist grooves.

7. The air conditioner indoor unit according to claim 6, wherein the waist groove has a length in a vertical direction of between 2 cm and 3 cm.

8. The air conditioner indoor unit according to claim 1, wherein the fastener is a bolt.

9. The air conditioner indoor unit according to claim 1, wherein the water collecting tray is further provided with a drainage tube connected to the drainage hole and configured to guide drainage.

10. The air conditioner indoor unit according to claim 9, wherein the water collecting tray is provided with a waterproof layer for waterproofing.

* * * * *